US006947012B2

(12) United States Patent
Aisenbrey

(10) Patent No.: US 6,947,012 B2
(45) Date of Patent: Sep. 20, 2005

(54) LOW COST ELECTRICAL CABLE CONNECTOR HOUSINGS AND CABLE HEADS MANUFACTURED FROM CONDUCTIVE LOADED RESIN-BASED MATERIALS

(75) Inventor: Thomas Aisenbrey, Littleton, CO (US)

(73) Assignee: Integral Technologies, Inc., Bellingham, WA (US)

( * ) Notice: Subject to any disclaimer, the term of this patent is extended or adjusted under 35 U.S.C. 154(b) by 0 days.

(21) Appl. No.: 10/884,322

(22) Filed: Jul. 2, 2004

(65) Prior Publication Data

US 2004/0235351 A1 Nov. 25, 2004

Related U.S. Application Data

(63) Continuation-in-part of application No. 10/309,429, filed on Dec. 4, 2002, now Pat. No. 6,870,516, which is a continuation-in-part of application No. 10/075,778, filed on Feb. 14, 2002, now Pat. No. 6,741,221.

(60) Provisional application No. 60/484,455, filed on Jul. 2, 2003, provisional application No. 60/317,808, filed on Sep. 7, 2001, provisional application No. 60/269,414, filed on Feb. 16, 2001, and provisional application No. 60/268,822, filed on Feb. 15, 2001.

(51) Int. Cl.[7] ..... H01Q 1/50

(52) U.S. Cl. ..... 343/906; 439/874; 439/916

(58) Field of Search ..... 343/906, 702, 343/783; 438/607, 916, 874; H01Q 1/50

(56) References Cited

U.S. PATENT DOCUMENTS

2002/0006743 A1 * 1/2002 Kanagawa et al. ..... 439/98
2002/0142676 A1 10/2002 Hosaka et al. ..... 439/874
2002/0142677 A1 * 10/2002 Hosaka et al. ..... 439/874
2002/0159235 A1 10/2002 Miller et al. ..... 361/704

FOREIGN PATENT DOCUMENTS

GB 2 377449 A 7/2001 ..... C08K/3/08

OTHER PUBLICATIONS

Co–pending U.S. Appl. No. 10/309,429, filed Dec. 04, 2002, "Low Cost Antennas Using Conductive Plastics or Conductive Composites", assigned to the same assignee.

* cited by examiner

*Primary Examiner*—Hoanganh Le
(74) *Attorney, Agent, or Firm*—George O. Saile; Stephen B. Ackerman; Douglas R. Schnabel

(57) ABSTRACT

Electrical connector housings are formed of a conductive loaded resin-based material which provides superior protection from EMI and RFI by absorbing such interfering signals. The conductive loaded resin-based material comprises micron conductive powder(s), conductive fiber(s), or a combination thereof, in a base resin host. The percentage by weight of the conductive powder(s), conductive fiber(s), or a combination thereof is between about 20% and 40% of the weight of the conductive loaded resin-based material. The micron conductive powders are formed from non-metals, such as carbon, graphite, that may also be metallic plated, or the like, or from metals such as stainless steel, nickel, copper, silver, that may also be metallic plated, or the like, or from a combination of non-metal, plated, or in combination with, metal powders. The micron conductor fibers preferably are of nickel plated carbon fiber, stainless steel fiber, copper fiber, silver fiber, or the like.

42 Claims, 5 Drawing Sheets

LOW COST ELECTRICAL CABLE CONNECTOR HOUSINGS AND CABLE HEADS MANUFACTURED FROM CONDUCTIVE LOADED RESIN-BASED MATERIALS

This Patent Application claims priority to the U.S. Provisional Patent Application No. 60/484455, filed on Jul. 2, 2003, which is herein incorporated by reference in its entirety.

This Patent Application is a Continuation-in-Part of INT01-002CIP, filed as U.S. patent application Ser. No. 10/309,429, filed on Dec. 4, 2002, now U.S. Pat. No. 6,870,516, also incorporated by reference in its entirety, which is a Continuation-in-Part application of docket number INT01-002, filed as U.S. patent application Ser. No. 10/075,778, filed on Feb. 14, 2002, now U.S. Pat. No. 6,741,221, which claimed priority to U.S. Provisional Patent Applications Ser. No. 60/317,808, filed on Sep. 7, 2001, Ser. No. 60/269,414, filed on Feb. 16, 2001, and Ser. No. 60/268,822, filed on Feb. 15, 2001.

BACKGROUND OF THE INVENTION (1) Field of the Invention

This invention relates to electrical cable connector housings and, more particularly, to electrical cable connector housings molded of conductive loaded resin-based materials comprising micron conductive powders, micron conductive fibers, or a combination thereof, homogenized within a base resin when molded. This manufacturing process yields a conductive part or material usable within the EMF or electronic spectrum(s).

(2) Description of the Prior Art

Electrical cable connector housings are widely used to accommodate the connection of one electrical cable to a separate electrical cable or device. Electrical cable connectors commonly contain electrically conductive terminals which facilitate electrical continuity between the two separate electrical cables and/or devices. An electrically non-conductive material is used to hold the terminals in position within the connector housing, thus providing electrical isolation between the terminals and other components. The connector housing substantially surrounds and/or encases the terminals and any other internal connector components. In many applications, it is beneficial for the connector to provide shielding from electromagnetic waves which can otherwise interfere with the signals being transmitted. Generally, metal connector housings are used for electrical cable applications where electromagnetic shielding is required. In contrast, plastic connector housings are generally used where electromagnetic shielding is not needed. Plastic housings for electrical cable connectors generally offer advantages such as low cost and ease of fabrication. Metal housings for electrical cable connectors, in contrast, offer protection against electromagnetic interference (EMI) but are more costly to manufacture and have increased weight.

U.S. Patent Application Publication U.S. 2002/0159235 A1 to Miller et al teaches an electronic connector including an improved heat dissipating housing for cooling heat generating devices located within the connector. More specifically, it teaches over-molding an outer housing comprising thermally conductive polymer material around the heat generating electronic component for the purpose of increasing heat transfer from the electronic component. U.S. Patent Application Publication U.S. 2002/0142676 to Hosaka et al teaches a method of connecting a twisted pair cable to the electric connector without undoing the twist of the end of the twisted pair cable. The application teaches an electric connector for twisted pair cable using resin solder, the electric connector comprising a pair of electric contacts having at least a part of the second connecting part made of a lead-free ultrahigh-conductive plastic being a conductive resin composite. The conductive resin composite taught in Hosaka et al comprises a thermoplastic resin, a lead-free solder that can be melted in the plasticated thermoplastic resin, and powder of a metal that assists fine dispersion of the lead-free solder in the thermoplastic resin or a mixture of the powder of the metal and short fibers of a metal. The application teaches melting lead-free solder to form connections; it does not address connector housings.

SUMMARY OF THE INVENTION

A principal object of the present invention is to provide effective electrical cable connector housings.

A further object of the present invention is to provide a method to form electrical cable connector housings.

A further object of the present invention is to provide electrical cable connector housings molded of conductive loaded resin-based materials.

A yet further object of the present invention is to provide electrical cable connector housings molded of conductive loaded resin-based materials wherein said conductive loaded resin-based materials provide protection against EMI, radio frequency interference (RFI) and other such interferences by absorbing the waves that cause interference.

A yet further object of the present invention is to provide electrical cable connector housings molded of conductive loaded resin-based material where the electrical cable connector housings characteristics can be altered or the visual characteristics can be altered by forming a metal layer over the conductive loaded resin-based material.

A yet further object of the present invention is to provide methods to fabricate electrical cable connector housings from a conductive loaded resin-based material incorporating various forms of the material.

A yet further object of the present invention is to provide a method to fabricate electrical cable connector housings from a conductive loaded resin-based material where the material is in the form of a fabric.

In accordance with the objects of this invention, a connector device is achieved. The connector device comprises a signal carrying portion and a connector housing. The connector housing comprises a conductive loaded, resin-based material comprising conductive materials in a base resin host. The connector housing substantially surrounds and electrically isolates the signal carrying portion of the connector.

Also in accordance with the objects of this invention, a connector device is achieved. The connector devices comprises a signal carrying portion and a connector housing. The connector housing comprises multiple components. At least one of the components comprises conductive loaded, resin-based material comprising conductive materials in a base resin host. The connector housing substantially surrounds and electrically isolates the signal carrying portion of the connector.

Also in accordance with the objects of this invention, a method to form a connector housing device is achieved. The method comprises providing a conductive loaded, resin-based material comprising conductive materials in a resin-based host. The conductive loaded, resin-based material is molded into a connector housing device.

BRIEF DESCRIPTION OF THE DRAWINGS

In the accompanying drawings forming a material part of this description, there is shown.

DESCRIPTION OF THE PREFERRED EMBODIMENTS

Figure 1A:
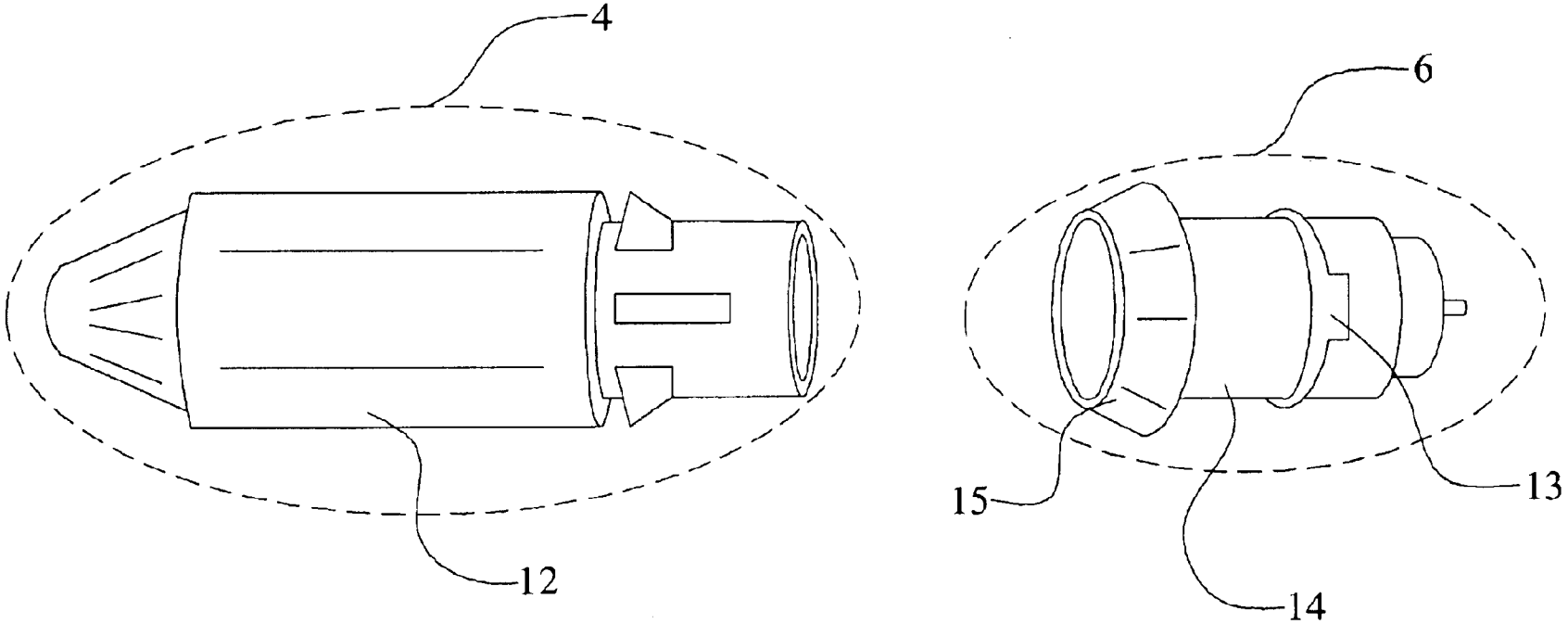
FIGS. 1*a* and 1*b* illustrate a first preferred embodiment of the present invention showing electrical cable connector housings comprising a conductive loaded resin-based material.

This invention relates to electrical cable connector housings molded of conductive loaded resin-based materials comprising micron conductive powders, micron conductive fibers, or a combination thereof, homogenized within a base resin when molded.

The conductive loaded resin-based materials of the invention are base resins loaded with conductive materials, which then makes any base resin a conductor rather than an insulator. The resins provide the structural integrity to the molded part. The micron conductive fibers, micron conductive powders, or a combination thereof, are homogenized within the resin during the molding process, providing the electrical continuity.

The conductive loaded resin-based materials can be molded, extruded or the like to provide almost any desired shape or size. The molded conductive loaded resin-based materials can also be cut, stamped, or vacuumed formed from an injection molded or extruded sheet or bar stock, over-molded, laminated, milled or the like to provide the desired shape and size. The thermal or electrical conductivity characteristics of electrical cable connector housings fabricated using conductive loaded resin-based materials depend on the composition of the conductive loaded resin-based materials, of which the loading or doping parameters can be adjusted, to aid in achieving the desired structural, electrical, absorbing, or other physical characteristics of the material. The selected materials used to fabricate the electrical cable connector housings devices are homogenized together using molding techniques and or methods such as injection molding, over-molding, thermo-set, protrusion, extrusion or the like. Characteristics related to 2D, 3D, 4D, and 5D designs, molding and electrical characteristics, include the physical and electrical advantages that can be achieved during the molding process of the actual parts and the polymer physics associated within the conductive networks within the molded part(s) or formed material(s).

The use of conductive loaded resin-based materials in the fabrication of electrical cable connector housings significantly lowers the cost of materials and the design and manufacturing processes used to hold ease of close tolerances, by forming these materials into desired shapes and sizes. The electrical cable connector housings can be manufactured into infinite shapes and sizes using conventional forming methods such as injection molding, over-molding, or extrusion or the like. The conductive loaded resin-based materials, when molded, typically but not exclusively produce a desirable usable range of sheet resistance from between about 5 and 25 ohms per square, but other resistivities can be achieved by varying the doping parameters and/or resin selection(s).

The conductive loaded resin-based materials comprise micron conductive powders, micron conductive fibers, or any combination thereof, which are homogenized together within the base resin, during the molding process, yielding an easy to produce low cost, electrically conductive, close tolerance manufactured part or circuit. The micron conductive powders can be of carbons, graphites, amines or the like, and/or of metal powders such as nickel, copper, silver, or plated or the like. The use of carbons or other forms of powders such as graphite(s) etc. can create additional low level electron exchange and, when used in combination with micron conductive fibers, creates a micron filler element within the micron conductive network of fiber(s) producing further electrical conductivity as well as acting as a lubricant for the molding equipment. The micron conductive fibers can be nickel plated carbon fiber, stainless steel fiber, copper fiber, silver fiber, or the like, or combinations thereof. The structural material is a material such as any polymer resin. Structural material can be, here given as examples and not as an exhaustive list, polymer resins produced by GE PLASTICS, Pittsfield, Mass., a range of other plastics produced by GE PLASTICS, Pittsfield, Mass., a range of other plastics produced by other manufacturers, silicones produced by GE SILICONES, Waterford, N.Y., or other flexible resin-based rubber compounds produced by other manufacturers.

The resin-based structural material loaded with micron conductive powders, micron conductive fibers, or in combination thereof can be molded, using conventional molding methods such as injection molding or over-molding, or extrusion to create desired shapes and sizes. The molded conductive loaded resin-based materials can also be stamped, cut or milled as desired to form create the desired shape form factor(s) of the heat sinks. The doping composition and directionality associated with the micron conductors within the loaded base resins can affect the electrical and structural characteristics of the electrical cable connector housings and can be precisely controlled by mold designs, gating and or protrusion design(s) and or during the molding process itself. In addition, the resin base can be selected to obtain the desired thermal characteristics such as very high melting point or specific thermal conductivity.

A resin-based sandwich laminate could also be fabricated with random or continuous webbed micron stainless steel fibers or other conductive fibers, forming a cloth like material. The webbed conductive fiber can be laminated or the like to materials such as Teflon, Polyesters, or any resin-based flexible or solid material(s), which when discretely designed in fiber content(s), orientation(s) and shape(s), will produce a very highly conductive flexible cloth-like material. Such a cloth-like material could also be used in forming electrical cable connector housings that could be embedded in a person's clothing as well as other resin materials such as rubber(s) or plastic(s). When using conductive fibers as a webbed conductor as part of a laminate or cloth-like material, the fibers may have diameters of between about 3 and 12 microns, typically between about 8 and 12 microns or in the range of about 10 microns, with length(s) that can be seamless or overlapping.

The conductive loaded resin-based material of the present invention can be made resistant to corrosion and/or metal electrolysis by selecting micron conductive fiber and/or micron conductive powder and base resin that are resistant to corrosion and/or metal electrolysis. For example, if a corrosion/electrolysis resistant base resin is combined with stainless steel fiber and carbon fiber/powder, then a corrosion and/or metal electrolysis resistant conductive loaded resin-based material is achieved. Another additional and important feature of the present invention is that the conductive loaded resin-based material of the present invention may be made flame retardant. Selection of a flame-retardant (FR) base resin material allows the resulting product to exhibit flame retardant capability. This is especially important in electrical cable connector housings applications as described herein.

The homogeneous mixing of micron conductive fiber and/or micron conductive powder and base resin described in the present invention may also be described as doping. That is, the homogeneous mixing converts the typically non-conductive base resin material into a conductive material. This process is analogous to the doping process whereby a semiconductor material, such as silicon, can be converted into a conductive material through the introduction of donor/acceptor ions as is well known in the art of semiconductor devices. Therefore, the present invention uses the term doping to mean converting a typically non-conductive base resin material into a conductive material through the homogeneous mixing of micron conductive fiber and/or micron conductive powder into a base resin.

As an additional and important feature of the present invention, the molded conductor loaded resin-based material exhibits excellent thermal dissipation characteristics. Therefore, electrical cable connector housings manufactured from the molded conductor loaded resin-based material can provide added thermal dissipation capabilities to the application. For example, heat can be dissipated from electrical devices physically and/or electrically connected to electrical cable connector housings of the present invention.

As a significant advantage of the present invention, electrical cable connector housings constructed of the conductive loaded resin-based material can be easily interfaced to an electrical circuit or grounded. In one embodiment, a wire can be attached to a conductive loaded resin-based electrical cable connector housing via a screw that is fastened to the electrical cable connector housing. For example, a simple sheet-metal type, self tapping screw can, when fastened to the material, achieve excellent electrical connectivity via the conductive matrix of the conductive loaded resin-based material. To facilitate this approach a boss may be molded into the conductive loaded resin-based material to accommodate such a screw. Alternatively, if a solderable screw material, such as copper, is used, then a wire can be soldered to the screw which is embedded into the conductive loaded resin-based material. In another embodiment, the conductive loaded resin-based material is partly or completely plated with a metal layer. The metal layer forms excellent electrical conductivity with the conductive matrix. A connection of this metal layer to another circuit or to ground is then made. For example, if the metal layer is solderable, then a soldered connection may be made between the electrical cable connector housings and a grounding wire.

Figure 1B:
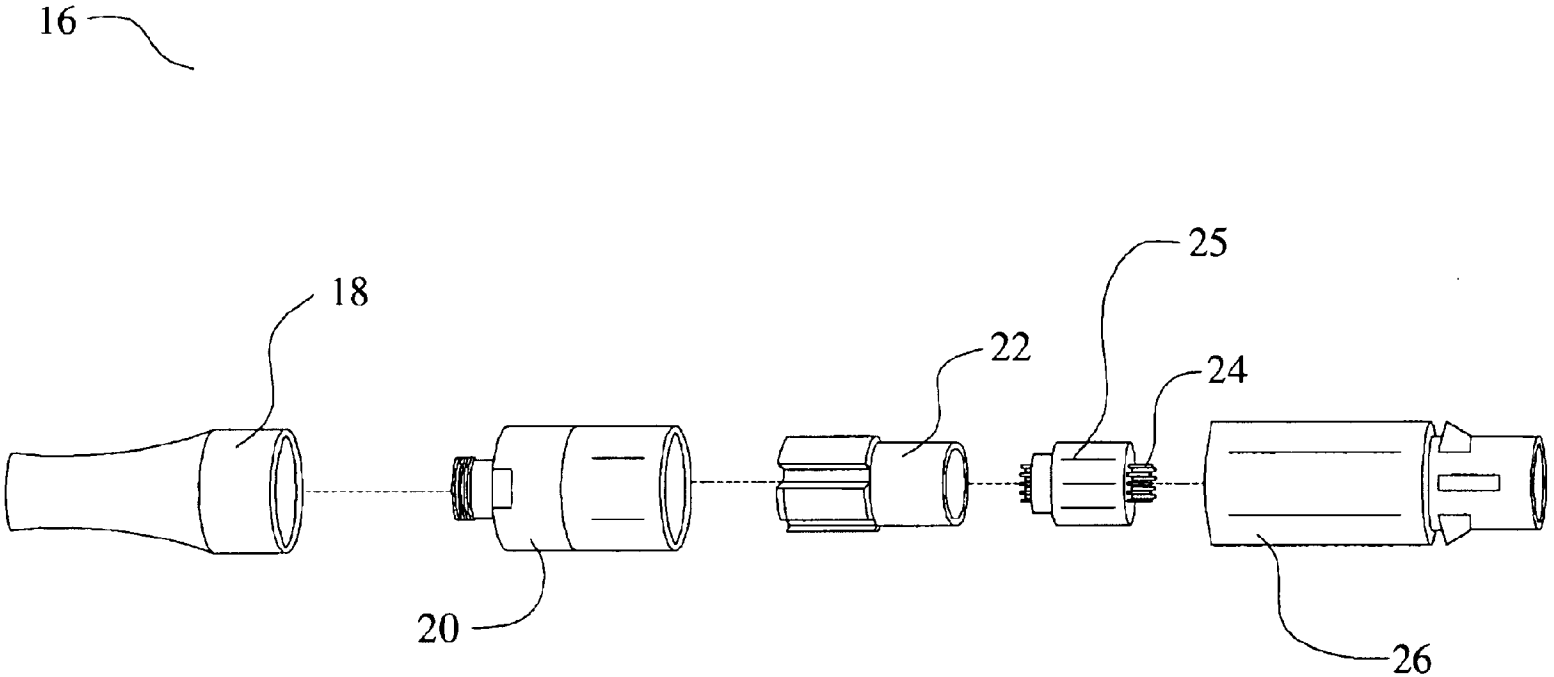

Referring now to FIGS. 1*a* and 1*b*, a first preferred embodiment of the present invention is illustrated. Several important features of the present invention are shown and discussed below. Referring to FIG. 1*a*, two exemplary connector housings, or cable heads, 4 and 6 are shown. These examples 4 and 6 represent only two of the many forms which connector housings may take according to the present invention. In one embodiment, these exemplary connector housings 4 and 6 are attached to a cable. In another embodiment, these connector housings 4 and 6 attach directly to a device such as an electronic "black box" or a microphone without means of an intermediate cable.

The exemplary male connector housing 4 serves to contain and protect the signal carrying portion, not shown, of the male connector. The signal carrying portion is well known and is commonly referred to as the male contact(s) or terminal(s) or pin(s). Referring now to FIG. 1*b*, the male connector housing 4 further comprises sub-components as a collet 22, a collet nut 20, a bend relief 18, and an outer shell 12. Referring again to FIG. 1*a*, the exemplary female connector housing 6 further comprises sub-components such as a front nut 15, a hexagonal nut 13, and an outer shell 14. The exemplary female connector housing 6 serves to contain and protect the signal carrying portion, not shown, of the female connector. Both the male and the female connector housings 4 and 6 comprise conductive loaded resin-based material according to the present invention. That is, conductive loaded resin-based materials are used to form any or all the components or sub-components of the male and female connector housings 4 and 6.

Referring now to FIG. 1*b*, an exploded view of an exemplary electrical cable connector assembly 16, or housing, is shown. The components of the exemplary connector assembly 16 include a bend relief 18, a collet nut 20, a collet 22, terminals 24, a terminal insulator 25, and an outer shell 26. Of these, any or all of the bend relief 18, the collet nut 20, the collet 22, and the outer shell 26 comprise the conductive loaded resin-based material of the present invention. The terminals 24 preferably comprise a metal conductor. However, in one embodiment of the present invention, the terminals 24 additionally comprise the conductive loaded resin-based material. The terminal insulator 25 mechanically keeps and electrically isolates the terminals 24 and comprises a non-conductive material. In one embodiment, the terminal insulator 25 comprises a resin-based material. In the illustrated embodiment, the conductive loaded resin-based material connector housing 16 is shown in exploded, or non-assembled form showing components comprising the bend relief 18, the collet nut 20, the collet 22, and the outer shell 26. In one preferred embodiment of the present invention, each of these components of the connector housing 16 comprises conductive loaded resin-based material. Alternately, in another preferred embodiment, at least one component of the connector housing 16, comprises conductive loaded resin-based material.

Referring now to both FIGS. 1*a* and 1*b*, the conductive loaded resin-based material of the present invention provides superior performance over conventional materials used for connector housing applications due to the inherent EMI/RFI absorbing quality of the conductive loaded resin-based material. This interference-absorbing characteristic is a significant advantage critical to the performance of many types of electrical cable. Cable connectors and device connectors which benefit from conductive loaded resin-based material include, but are not limited to, the following applications: automotive connectors, military connectors, airplane connectors, oil field connectors, musical equipment connectors, broadcasting-related connectors, and the like.

In the prior art, metal connectors are typically used to protect against EMI/RFI. However, these metal connectors are designed to shield, or reflect, interfering signals rather than to absorb these signals. As a result, any electromagnetic energy, or interfering signal, that passes through, or slips around, the metal connector is simply reflected, repeatedly, off the interior surfaces of the metal connector. This interfering signal remains free to interfere with the desired signal that is being carried in the electrical cable and the housing. Therefore, the signal-to-noise performance of the electrical cable can be hindered by the use of metal connectors. Alternatively, non-conductive plastic connector housing have been proposed in the art. However, these common plastic connectors are even more susceptible to electromagnetic interference than metal connectors.

By comparison, the connectors of the present invention provide superior protection from EMI/RFI by absorbing interfering signals into the conductive loaded resin-based housings 4 and 6. Undesirable electromagnetic interference is absorbed into the housing 4 and 6 and is then easily shunted to ground. The excellent absorption of the novel conductive loaded resin-based material dramatically reduces the amount of electromagnetic energy that passes through the connector housing and into the signal carrier that is enclosed within the connector housing 4 and 6. Further, where the interfering signal does penetrate the absorptive housing 4 and 6, this interfering signal is then promptly absorbed by the interior of the connector housing 4 and 6, again due to the inherent absorbing quality of the conductive loaded resin-based material of the present invention. In this way, superior protection is provided by conductive loaded resin-based material connector housings 4 and 6 of the present invention.

A further benefit of the conductive loaded resin-based material connector housings 4 and 6 of FIG. 1*a* and connector components 18, 20, 22, and 26 of FIG. 1*b* is low cost. Conductive loaded resin-based material connector housings 4 and 6 of the present invention are produced using conventional, economical forming techniques such as injection molding or extrusion. This provides components which are significantly more economical to produce than metal components. Weight savings is another benefit of conductive loaded resin-based material connector housings compared to metal housings. The desired physical, thermal, electrical, and chemical properties of the conductive loaded resin-based material are achieved by varying the host resin and conductive materials selected for each particular connector application. In this way, desired properties such as thermal conductivity, protection against moisture, flame retardant qualities, appearance, and high temperature resistance are achieved. The connector housings 4 and 6 shown merely represent the many shapes, forms, types and applications of connector housings comprising conductive loaded resin-based material.

As a further, though optional, feature, a metal layer may be applied to the connector housings 4 and 6 to alter the visual, thermal, electrical, or other properties of the devices. If a metal layer, not shown, is used on the connector housing, it may be formed by plating or by coating. If the method of formation is metal plating, then the resin-based structural material of the conductive loaded, resin-based material is one that can be metal plated. There are many of the polymer resins that can be plated with metal layers. For example, GE Plastics, SUPEC, VALOX, ULTEM, CYCOLAC, UGIKRAL, STYRON, CYCOLOY are a few resin-based materials that can be metal plated. The metal layer may be formed by, for example, electroplating or physical vapor deposition.

Figure 2:
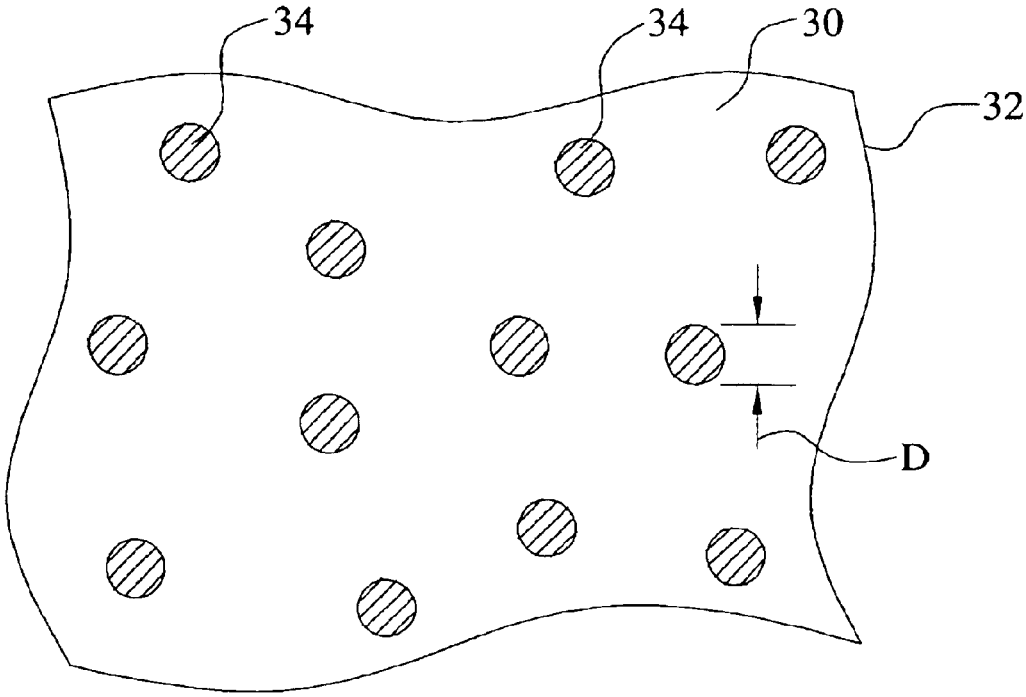
FIG. 2 illustrates a first preferred embodiment of a conductive loaded resin-based material wherein the conductive materials comprise a powder.

The conductive loaded resin-based material typically comprises a micron powder(s) of conductor particles and/or in combination of micron fiber(s) homogenized within a base resin host. FIG. 2 shows a cross sectional view of an example of conductor loaded resin-based material 32 having powder of conductor particles 34 in a base resin host 30. In this example the diameter D of the conductor particles 34 in the powder is between about 3 and 12 microns.

Figure 3:
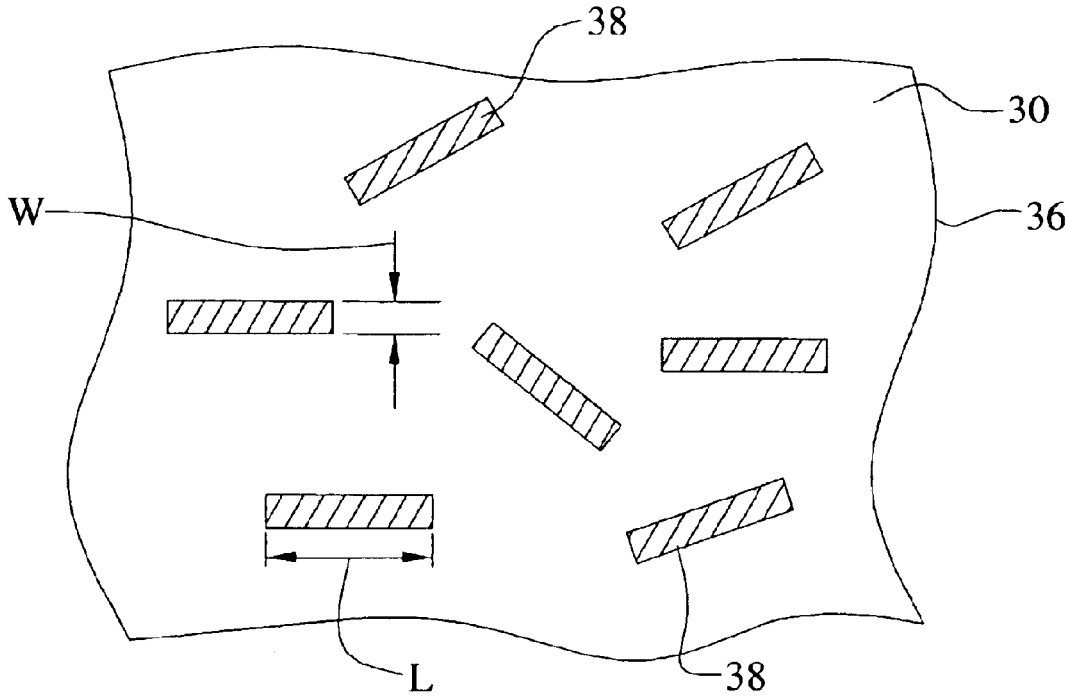
FIG. 3 illustrates a second preferred embodiment of a conductive loaded resin-based material wherein the conductive materials comprise micron conductive fibers.
Figure 4:
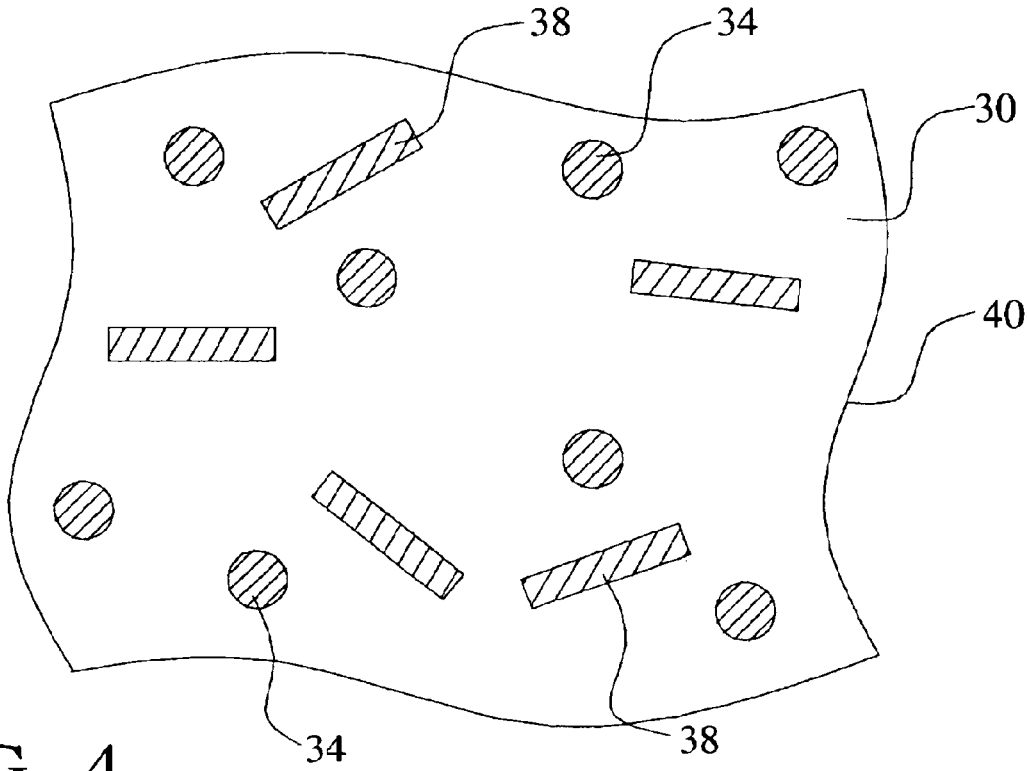
FIG. 4 illustrates a third preferred embodiment of a conductive loaded resin-based material wherein the conductive materials comprise both conductive powder and micron conductive fibers.

FIG. 3 shows a cross section view of an example of conductor loaded resin-based material 36 having conductor fibers 38 in a base resin host 30. The conductor fibers 38 have a diameter of between about 3 and 12 microns, typically in the range of 10 microns or between about 8 and 12 microns, and a length of between about 2 and 14 millimeters. The conductors used for these conductor particles 34 or conductor fibers 38 can be stainless steel, nickel, copper, silver, or other suitable metals or conductive fibers, or combinations thereof. These conductor particles and or fibers are homogenized within a base resin. As previously mentioned, the conductive loaded resin-based materials have a sheet resistance between about 5 and 25 ohms per square, though other values can be achieved by varying the doping parameters and/or resin selection. To realize this sheet resistance the weight of the conductor material comprises between about 20% and about 50% of the total weight of the conductive loaded resin-based material. More preferably, the weight of the conductive material comprises between about 20% and about 40% of the total weight of the conductive loaded resin-based material. More preferably yet, the weight of the conductive material comprises between about 25% and about 35% of the total weight of the conductive loaded resin-based material. Still more preferably yet, the weight of the conductive material comprises about 30% of the total weight of the conductive loaded resin-based material. Stainless Steel Fiber of 8–11 micron in diameter and lengths of 4–6 mm and comprising, by weight, about 30% of the total weight of the conductive loaded resin-based material will produce a very highly conductive parameter, efficient within any EMF spectrum. Referring now to FIG. 4, another preferred embodiment of the present invention is illustrated where the conductive materials comprise a combination of both conductive powders 34 and micron conductive fibers 38 homogenized together within the resin base 30 during a molding process.

Figure 5A:
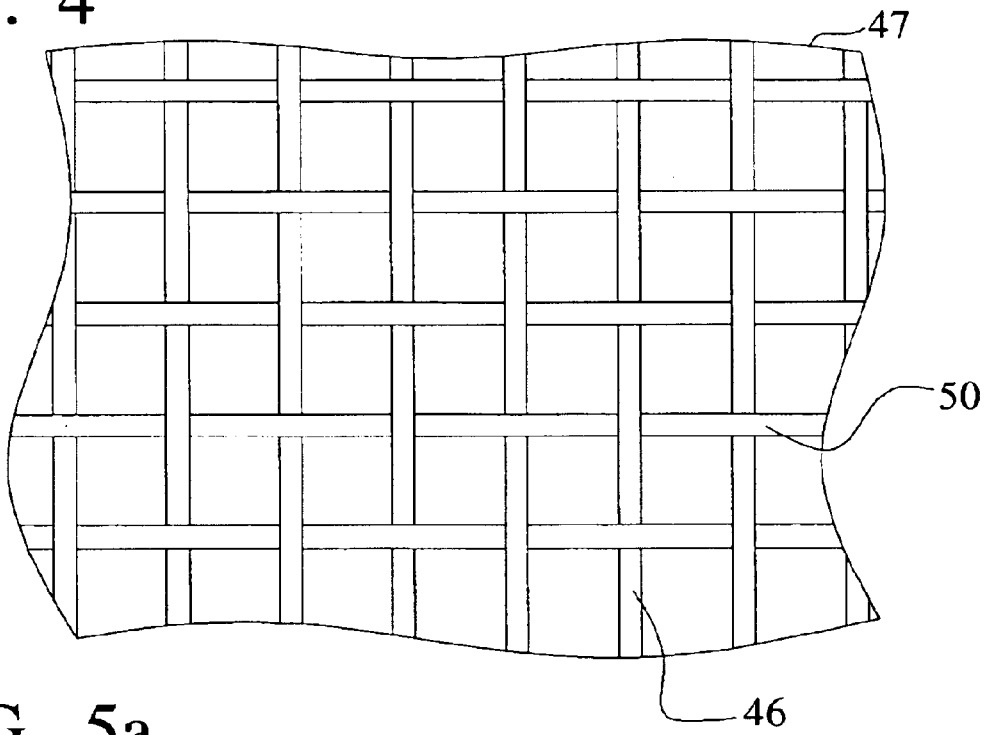
FIGS. 5*a* and 5*b* illustrate a fourth preferred embodiment wherein conductive fabric-like materials are formed from the conductive loaded resin-based material.
Figure 5B:
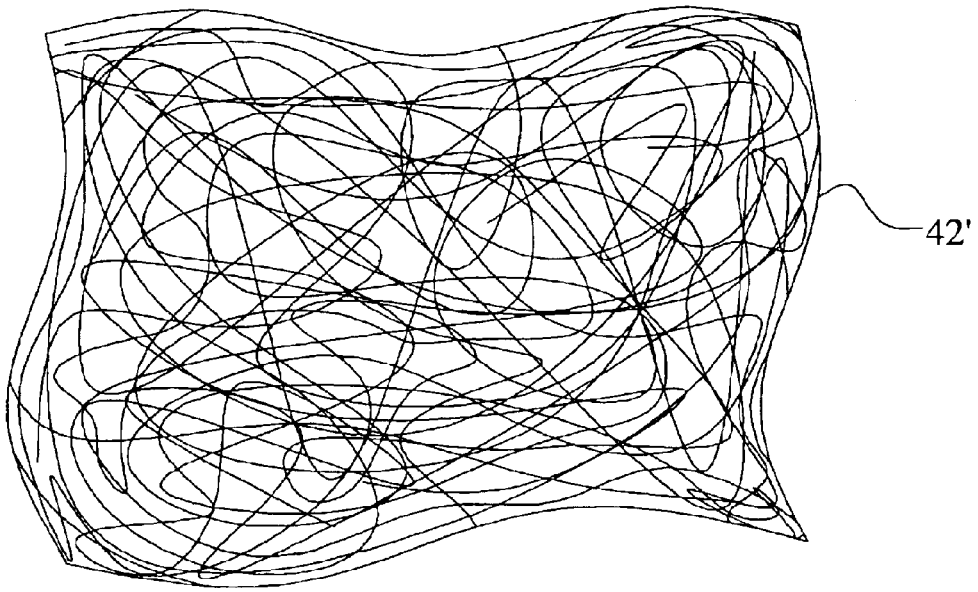

Referring now to FIGS. 5*a* and 5*b*, a preferred composition of the conductive loaded, resin-based material is illustrated. The conductive loaded resin-based material can be formed into fibers or textiles that are then woven or webbed into a conductive fabric. The conductive loaded resin-based material is formed in strands that can be woven as shown. FIG. 5*a* shows a conductive fabric 42 where the fibers are woven together in a two-dimensional weave 46 and 50 of fibers or textiles. FIG. 5*b* shows a conductive fabric 42' where the fibers are formed in a webbed arrangement. In the webbed arrangement, one or more continuous strands of the conductive fiber are nested in a random fashion. The resulting conductive fabrics or textiles 42, see FIG. 5*a*, and 42', see FIG. 5*b*, can be made very thin, thick, rigid, flexible or in solid form(s).

Similarly, a conductive, but cloth-like, material can be formed using woven or webbed micron stainless steel fibers, or other micron conductive fibers. These woven or webbed conductive cloths could also be sandwich laminated to one or more layers of materials such as Polyester(s), Teflon(s), Kevlar(s) or any other desired resin-based material(s). This conductive fabric may then be cut into desired shapes and sizes.

Figure 6A:
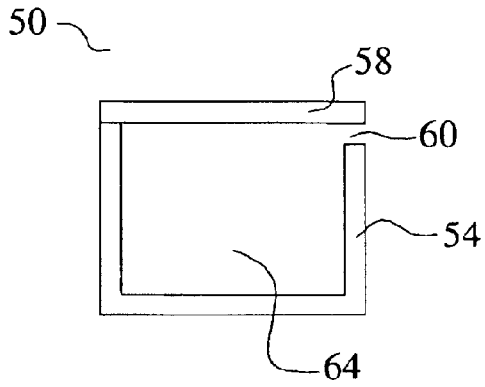
FIGS. 6*a* and 6*b* illustrate, in simplified schematic form, an injection molding apparatus and an extrusion molding apparatus that may be used to mold electrical cable connector housings of a conductive loaded resin-based material.

Electrical cable connector housings formed from conductive loaded resin-based materials can be formed or molded in a number of different ways including injection molding, extrusion or chemically induced molding or forming. FIG. 6*a* shows a simplified schematic diagram of an injection mold showing a lower portion 54 and upper portion 58 of the mold 50. Conductive loaded blended resin-based material is injected into the mold cavity 64 through an injection opening 60 and then the homogenized conductive material cures by thermal reaction. The upper portion 58 and lower portion 54 of the mold are then separated or parted and the electrical cable connector housings are removed.

Figure 6B:
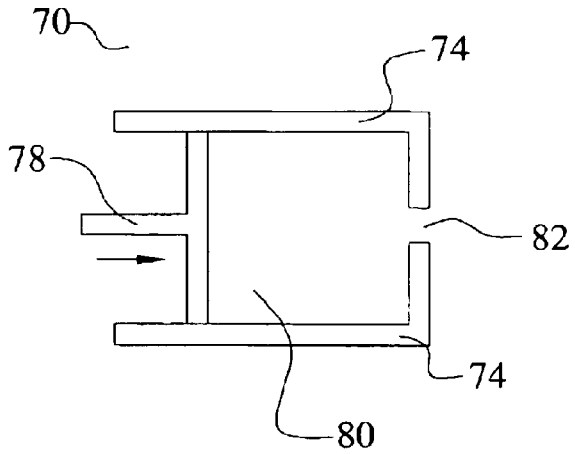

FIG. 6*b* shows a simplified schematic diagram of an extruder 70 for forming electrical cable connector housings using extrusion. Conductive loaded resin-based material(s) is placed in the hopper 80 of the extrusion unit 74. A piston, screw, press or other means 78 is then used to force the thermally molten or a chemically induced curing conductive loaded resin-based material through an extrusion opening 82 which shapes the thermally molten curing or chemically induced cured conductive loaded resin-based material to the desired shape. The conductive loaded resin-based material is then fully cured by chemical reaction or thermal reaction to a hardened or pliable state and is ready for use. Thermoplastic or thermosetting resin-based materials and associated processes may be used in molding the conductive loaded resin-based articles of the present invention.

The advantages of the present invention may now be summarized. Effective electrical cable connector housings are achieved. A method to form electrical cable connector housings is described. The electrical cable connector housings are molded of conductive loaded resin-based materials. The electrical cable connector housings molded of conductive loaded resin-based materials provide protection against EMI, radio frequency interference (RFI) and other such interferences by absorbing the electromagnetic energy that causes interference. Electrical cable connector housings molded of conductive loaded resin-based material exhibit performance and/or visual characteristics that can be altered by forming a metal layer over the conductive loaded resin-based material. Methods to fabricate electrical cable connector housings from a conductive loaded resin-based material incorporating various forms of the material. A method is described to fabricate electrical cable connector housings from a conductive loaded resin-based material where the material is in the form of a fabric.

As shown in the preferred embodiments, the novel methods and devices of the present invention provide an effective and manufacturable alternative to the prior art.

While the invention has been particularly shown and described with reference to the preferred embodiments thereof, it will be understood by those skilled in the art that various changes in form and details may be made without departing from the spirit and scope of the invention.

What is claimed is:

1. A connector device comprising:

a signal carrying portion, and a connector housing comprising a conductive loaded, resin-based material comprising micron conductive fiber in a base resin host wherein said connector housing substantially surrounds and electrically isolates said signal carrying portion, wherein the percent by weight of said micron conductive fiber is between 20% and 50% of the total weight of said conductive loaded resin-based material.

2. The device according to claim 1 wherein the percent by weight of said micron conductive fiber is between about 20% and about 40% of the total weight of said conductive loaded resin-based material.

3. The device according to claim 1 wherein the percent by weight of said micron conductive fiber is between about 25% and about 35% of the total weight of said conductive loaded resin-based material.

4. The device according to claim 1 wherein said connector housing comprises multiple components and wherein at least one of said components comprises a conductive loaded, resin-based material comprising micron conductive fiber in a base resin host.

5. The device according to claim 4 wherein said components of said connector housing are a collet, a collet nut, an outer shell, a latch sleeve, a front nut, a hexagonal nut, a bend relief, or any combination thereof.

6. The device according to claim 1 further comprising a metal powder in said base resin host.

7. The device according to claim 6 wherein said metal powder is nickel, copper, or silver.

8. The device according to claim 6 wherein said metal powder is a non-conductive material with a metal plating.

9. The device according to claim 8 wherein said metal plating is nickel, copper, silver, or alloys thereof.

10. The device according to claim 6 wherein said metal powder comprises a diameter of between about 3 $\mu$m and about 12 $\mu$m.

11. The device according to claim 1 further comprising a non-metal powder in said base resin host.

12. The device according to claim 11 wherein said non-metal powder is carbon, graphite, or an amine-based material.

13. The device according to claim 1 further comprising a combination of metal powder and non-metal powder in said base resin host.

14. The device according to claim 1 wherein said micron conductive fiber is nickel plated carbon fiber, or stainless steel fiber, or copper fiber, or silver fiber or combinations thereof.

15. The device according to claim 1 wherein said micron conductive fiber has a diameter of between about 3 $\mu$m and about 12 $\mu$m and a length of between about 2 mm and about 14 mm.

16. The device according to claim 1 wherein said micron conductive fiber is stainless steel and wherein the percent by weight of said stainless steel fiber is between about 20% and about 40% of the total weight of said conductive loaded resin-based material.

17. The device according to claim 16 wherein said stainless steel fiber has a diameter of between about 3 $\mu$m and about 12 $\mu$m and a length of between about 2 mm and about 14 mm.

18. The device according to claim 1 further comprising micron conductive powder in said base resin host and wherein said micron conductive fiber is stainless steel.

19. The device according to claim 1 wherein said base resin and said conductive materials comprise flame-retardant materials.

20. The device according to claim 1 further comprising a metal layer overlying said conductive loaded resin-based material.

21. A connector device comprising:

a signal carrying portion, and a connector housing comprising multiple components wherein at least one of said components comprises a conductive loaded, resin-based material comprising micron conductive fiber in a base resin host, and wherein said connector housing substantially surrounds and electrically isolates said signal carrying portion, and wherein the percent by weight of said micron conductive fiber is between 20% and 50% of the total weight of said conductive loaded resin-based material.

22. The device according to claim 21 wherein said components of said connector housing are a collet, a collet nut, an outer shell, a latch sleeve, a front nut, a hexagonal nut, a bend relief, or any combination thereof.

23. The device according to claim 21 wherein said micron conductive fiber comprises stainless steel fiber, wherein said stainless steel fiber has a diameter of between about 3 $\mu$m and about 12 $\mu$m and a length of between about 2 mm and about 14 mm, and wherein the percent by weight of said stainless steel fiber is between about 20% and about 40% of the total weight of said conductive loaded resin-based material.

24. The device according to claim 21 wherein the percent by weight of said micron conductive fiber is between about 20% and about 40% of the total weight of said conductive loaded resin-based material.

25. The device according to claim 21 wherein the percent by weight of said micron conductive fiber is between about 25% and about 35% of the total weight of said conductive loaded resin-based material.

26. The device according to claim 21 further comprising metal powder in said base resin host.

27. The device according to claim 26 wherein said metal powder is a non-conductive material with a metal plating.

28. The device according to claim 21 further comprising non-metal powder in said base resin host.

29. The device according to claim 21 further comprising a combination of metal powder and non-metal powder in said base resin host.

30. The device according to claim 21 wherein said micron conductive fiber is stainless steel.

31. The device according to claim 21 wherein said base resin and said conductive materials comprise flame-retardant materials.

32. The device according to claim 21 further comprising a metal layer overlying said conductive loaded resin-based material.

33. A method to form a connector housing device, said method comprising:

providing a conductive loaded, resin-based material comprising micron conductive fiber in a resin-based host wherein the percent by weight of said micron conductive fiber is between 20% and 40% of the total weight of said conductive loaded resin-based material; and molding said conductive loaded, resin-based material into a connector housing device.

34. The method according to claim 33 wherein said micron conductive fiber is nickel plated carbon fiber, or stainless steel fiber, or copper fiber, or silver fiber or combinations thereof.

35. The method according to claim 33 wherein said micron conductive fiber has a diameter of between about 3 $\mu$m and about 12 $\mu$m and a length of between about 2 mm and about 14 mm.

36. The method according to claim 33 wherein said micron conductive fiber is stainless steel and wherein the percent by weight of said stainless steel fiber is between about 20% and about 40% of the total weight of said conductive loaded resin-based material.

37. The method according to claim 36 wherein said stainless steel fiber has a diameter of between about 3 $\mu$m and about 12 $\mu$m and a length of between about 2 mm and about 14 mm.

38. The method according to claim 33 further comprising conductive powder in said base resin host.

39. The method according to claim 33 wherein said molding comprises:

injecting said conductive loaded, resin-based material into a mold;

curing said conductive loaded, resin-based material; and removing said connector housing device from said mold.

40. The method according to claim 33 wherein said molding comprises:

loading said conductive loaded, resin-based material into a chamber;

extruding said conductive loaded, resin-based material out of said chamber through a shaping outlet; and curing said conductive loaded, resin-based material to form said connector housing device.

41. The method according to claim 33 further comprising subsequent mechanical processing of said molded conductive loaded, resin-based material.

42. The method according to claim 33 further comprising overlying a layer of metal on said molded conductive loaded, resin-based material.

* * * * *